US010358898B2

(12) United States Patent
Frosell

(10) Patent No.: US 10,358,898 B2
(45) Date of Patent: Jul. 23, 2019

(54) SAND CONTROL SCREEN ASSEMBLIES WITH EROSION-RESISTANT FLOW PATHS

(71) Applicant: Halliburton Energy Sevices, Inc., Houston, TX (US)

(72) Inventor: Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 280 days.

(21) Appl. No.: 14/900,232

(22) PCT Filed: Feb. 13, 2015

(86) PCT No.: PCT/US2015/015929
§ 371 (c)(1),
(2) Date: Dec. 21, 2015

(87) PCT Pub. No.: WO2016/130159
PCT Pub. Date: Aug. 18, 2016

(65) Prior Publication Data
US 2016/0369602 A1 Dec. 22, 2016

(51) Int. Cl.
*E21B 33/12* (2006.01)
*E21B 43/04* (2006.01)
(Continued)

(52) U.S. Cl.
CPC ..... *E21B 43/086* (2013.01); *E21B 33/12* (2013.01); *E21B 43/04* (2013.01); *E21B 43/08* (2013.01); *E21B 43/14* (2013.01)

(58) Field of Classification Search
CPC ..... E21B 33/12; E21B 43/04; E21B 43/08; E21B 43/086; E21B 43/14
See application file for complete search history.

(56) References Cited

U.S. PATENT DOCUMENTS 98,766 A * 1/1870 Harter ..... E21B 43/086 166/236
1,629,018 A * 5/1927 Coberly ..... E21B 43/086 166/229

(Continued)

FOREIGN PATENT DOCUMENTS

CN 201162499 Y 12/2008

OTHER PUBLICATIONS

International Search Report and Written Opinion for PCT/US2015/015929 dated Oct. 20, 2015.

*Primary Examiner* — James G Sayre
(74) *Attorney, Agent, or Firm* — McGuireWoods LLP

(57) ABSTRACT

A sand control screen assembly includes a base pipe having an interior and defining one or more flow ports. At least one sand screen is arranged about the exterior of the base pipe and has a predetermined screen gauge. At least one dead space is axially offset from the at least one sand screen and comprises at least one of an axial length of the base pipe and a shroud arranged about an exterior of the base pipe and extending axially from the at least one sand screen. One or more perforations are provided at the at least one dead space and are defined through at least one of the axial length of the base pipe and the shroud. Each perforation defines an opening and an erosion-resistant material deposited at the opening. A size of the opening is equal to or smaller than the predetermined screen gauge.

20 Claims, 4 Drawing Sheets

(51) Int. Cl.
*E21B 43/08* (2006.01)
*E21B 43/14* (2006.01)

(56) References Cited

U.S. PATENT DOCUMENTS

| | | | | | |
|---|---|---|---|---|---|
| 2,177,949 | A * | 10/1939 | Schlumpf | E21B 43/086 | 148/521 |
| 2,872,984 | A * | 9/1955 | Fether | E21B 43/086 | 166/235 |
| 5,787,980 | A * | 8/1998 | Sparlin | E21B 43/088 | 166/231 |
| 6,092,604 | A * | 7/2000 | Rice | B01D 29/15 | 166/228 |
| 6,857,476 | B2 * | 2/2005 | Richards | E21B 43/04 | 166/227 |
| 8,316,952 | B2 | 11/2012 | Moen | | |
| 8,602,113 | B2 | 12/2013 | Jin et al. | | |
| 2008/0134508 | A1 * | 6/2008 | Pegoretti | B23K 9/173 | 29/896.6 |
| 2008/0169099 | A1 | 7/2008 | Pensgaard | | |
| 2009/0095471 | A1 | 4/2009 | Guignard et al. | | |
| 2011/0247813 | A1 * | 10/2011 | Moen | E21B 43/088 | 166/278 |
| 2013/0112399 | A1 * | 5/2013 | Royer | E21B 41/0078 | 166/222 |
| 2014/0326447 | A1 * | 11/2014 | Fermaniuk | E21B 43/086 | 166/227 |

* cited by examiner

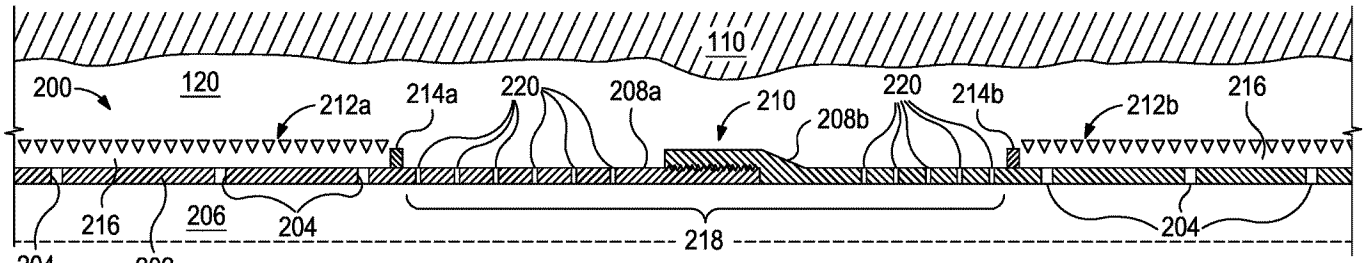
FIG. 2
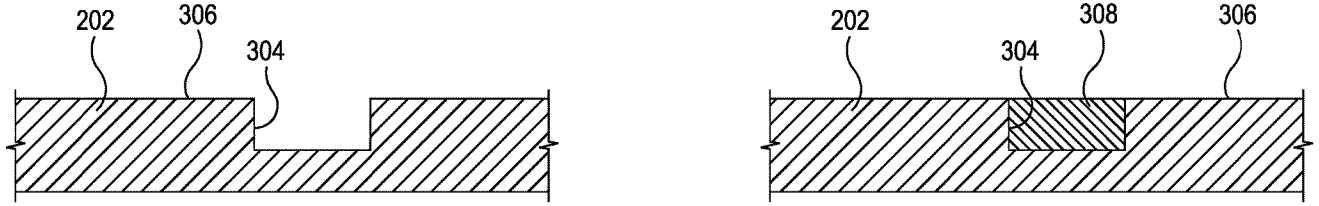
FIG. 3A
FIG. 3B
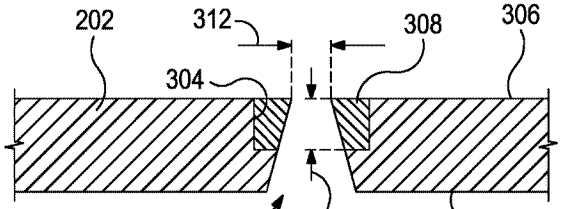
FIG. 3C

SAND CONTROL SCREEN ASSEMBLIES WITH EROSION-RESISTANT FLOW PATHS

BACKGROUND

During hydrocarbon production from subsurface formations, efficient control of the movement of unconsolidated formation particles into the wellbore, such as sand or other debris, has always been a pressing concern. Such formation movement commonly occurs during production from completions in loose sandstone or following the hydraulic fracture of a subterranean formation. Formation movement can also occur suddenly in the event a section of the wellbore collapses, thereby circulating significant amounts of particulates and fines within the wellbore. Production of these unwanted materials can cause numerous problems while extracting oil and gas from subterranean formations. For example, producing formation particles can plug production tubing and subsurface flow lines, and can result in the erosion of casing, downhole equipment, and surface equipment. These problems lead to high maintenance costs and unacceptable well downtime.

Numerous methods have been utilized to control the production of unconsolidated formation particles during production. Sand control screen assemblies, for instance, are used to regulate and restrict the influx of formation particles. A typical sand control screen assembly generally includes a wire a wrapped screen or single or multi-layer wire mesh screen positioned about a perforated base pipe. In operation, the sand control screen assembly allows fluids to flow therethrough but prevents the influx of particulate matter of a predetermined size and greater.

Another method to control and otherwise reduce the production of unconsolidated formation particles during production is to gravel pack the wellbore annulus defined between a sand control screen assembly and the wellbore wall. In a gravel-packing operation, a gravel slurry substantially comprising a fluid and particulate matter (e.g., engineered gravel or sand) is pumped into the wellbore annulus and the particulate matter is sized such that it is prevented from penetrating the sand screen. Upon drawing the fluid out of the gravel slurry through the sand screens, the particulate matter remains and is converted into a fluid porous sand pack that prevents the passage of formation sand into the base pipe.

Sand control screen assemblies, however, often have "dead spaces" extending along various axial lengths of the base pipe and where there is no fluid flow through the wall of the base pipe. A dead space, for instance, exists at the ends of connecting base pipes where each base pipe provides an area on its exterior for handling the base pipes in making up the connection. Another type of dead space may exist between axially adjacent screen sections that are coupled with an impermeable shroud that interposes the two screen sections. Since there is no fluid flow into the base pipe at these dead spaces, a void or poor quality gravel pack often results across dead spaces. This can result in portions of the sand pack settling in the dead spaces during production operation, and thereby exposing portions of adjacent sand screens. As will be appreciated, an exposed sand screen is susceptible to erosion and abrasion caused by inflowing fluid and debris, which could ultimately damage the sand screen and frustrate its operative purpose.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIG. 2 is a cross-sectional side view of an exemplary sand control screen assembly.

FIGS. 3A-3C depict progressive cross-sectional side views of the formation of an exemplary perforation.

DETAILED DESCRIPTION

The present disclosure generally relates to downhole fluid flow control and, more particularly, to sand control screen assemblies that incorporate erosion-resistant flow paths through dead spaces defined along the axial length of the sand control screen assemblies.

The embodiments described herein provide flow paths through dead spaces provided in sand control screen assemblies. An example sand control screen assembly may include a base pipe having an interior and defining one or more flow ports, and at least one sand screen arranged about the exterior of the base pipe. The dead space(s) of the sand control screen assembly may be axially offset from the sand screen(s) and, in one embodiment, may include an axial length of the base pipe. In other embodiments, the dead space(s) of the sand control screen assembly may include a shroud arranged about the exterior of the base pipe and extending axially from the at least one sand screen. One or more perforations or "slots" may be provided at the dead space(s) and are defined through at least one of the axial length of the base pipe and the shroud. Each perforation may define an opening and an erosion-resistant material deposited at the opening, and a size of the opening may be equal to or smaller than a predetermined screen gauge of the sand screen(s). The perforations may prove advantageous in allowing fluid leakage through the dead space(s) and into the base pipe, and thereby mitigating poor sand packs during gravel packing operations. Moreover, the erosion-resistant material applied at the perforations prevents erosion of the perforations for the life of the sand control screen assembly.

Figure 1:
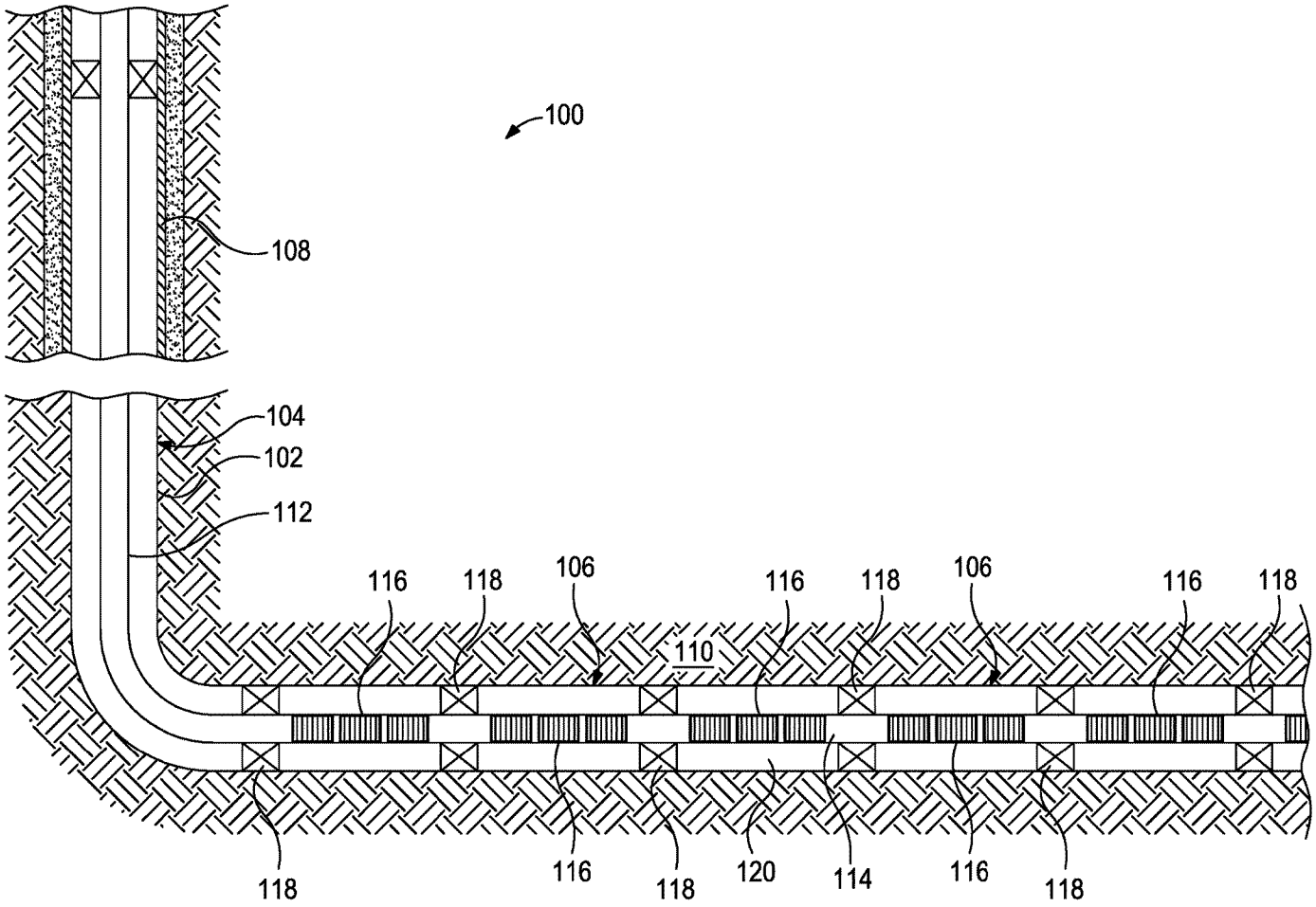
FIG. 1 is a schematic of a well system that may employ the principles of the present disclosure.

Referring to FIG. 1, illustrated is a well system 100 that may employ the principles of the present disclosure, according to one or more embodiments of the disclosure. As depicted, the well system 100 includes a wellbore 102 that extends through various earth strata and has a substantially vertical section 104 extending to a substantially horizontal section 106. As illustrated, the upper portion of the vertical section 104 may have a casing string 108 cemented therein, and the horizontal section 106 may extend through a hydrocarbon bearing subterranean formation 110. In at least one embodiment, the horizontal section 106 may be arranged within or otherwise extend through an open hole section of the wellbore 102.

A tubing string 112 may be positioned within the wellbore 102 and extend from the surface (not shown). In production operations, the tubing string 112 provides a conduit for fluids extracted from the formation 110 to travel to the surface. In injection operations, the tubing string 112 provides a conduit for fluids introduced into the wellbore 102 at the surface to be injected into the formation 110. At its lower end, the tubing string 112 may be coupled to a completion string 114 configured to be positioned within the horizontal section 106. The completion string 114 serves to divide the completion interval into various production intervals adjacent the formation 110. As depicted, the completion string 114 may include a plurality of sand control screen assemblies 116 axially offset from each other along portions of the completion string 114. Each sand control screen assembly 116 may be positioned between a pair of packers 118 that provides a fluid seal between the completion string 114 and the wellbore 102, thereby defining corresponding production intervals. In operation, the sand control screen assemblies 116 serve the primary function of filtering particulate matter out of the production fluid stream such that particulates and other fines are not produced to the surface via the tubing string 112.

In some embodiments, the annulus 120 defined between the sand control screen assemblies 116 and the wall of the wellbore 102, and in between adjacent packers 118, may be packed with gravel or "gravel-packed." In other embodiments, however, the annulus 120 may remain unpacked, without departing from the scope of the disclosure.

It should be noted that even though FIG. 1 depicts the sand control screen assemblies 116 as being arranged in an open hole portion of the wellbore 102, embodiments are contemplated herein where one or more of the sand control screen assemblies 116 is arranged within cased portions of the wellbore 102. Also, even though FIG. 1 depicts a single sand control screen assembly 116 arranged in each production interval, it will be appreciated by those skilled in the art that any number of screen assemblies 116 may be deployed within a given production interval without departing from the scope of the disclosure. In addition, even though FIG. 1 depicts multiple production intervals separated by the packers 118, it will be understood by those skilled in the art that the completion interval may include any number of production intervals with a corresponding number of packers 118 arranged therein. In other embodiments, the packers 118 may be entirely omitted from the completion interval, without departing from the scope of the disclosure.

Moreover, while FIG. 1 depicts the screen assemblies 116 as being arranged in a generally horizontal section 106 of the wellbore 102, those skilled in the art will readily recognize that the screen assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Referring now to FIG. 2, with continued reference to FIG. 1, illustrated is a cross-sectional side view of an exemplary sand control screen assembly 200, according to one or more embodiments. The sand control screen assembly 200 (hereafter "the screen assembly 200") may be the same as or similar to any of the sand control screen assemblies 116 of FIG. 1 and may therefore be used in the well system 100 depicted therein. The screen assembly 200 may include or otherwise be arranged about a base pipe 202 that defines one or more openings or flow ports 204 configured to provide fluid communication between an interior 206 of the base pipe 202 and the surrounding formation 110. The base pipe 202 may form part of the completion string 114 of FIG. 1 and, as illustrated, may comprise at least two tubular lengths, shown as a first base pipe portion 208*a* and a second base pipe portion 208*b*. Adjacent ends of the first and second base pipe portions 208*a,b* may be coupled at a coupling 210, which may comprise a threaded connection, as illustrated, or any other type of tubing connection or connector.

The screen assembly 200 may further include one or more sand screens 212 arranged about the base pipe 202, shown as a first or upper sand screen 212*a* disposed about the first base pipe portion 208*a* and a second or lower sand screen 212*b* disposed about the second base pipe portion 208*b*. The first sand screen 212*a* may extend axially from a first or upper end ring 214*a* arranged about the first base pipe portion 208*a*, and the second sand screen 212*b* may extend axially from a second or lower end ring 214*b* arranged about the second base pipe portion 208*b*. The first and second end rings 214*a,b* provide a mechanical interface between the base pipe 202 and the corresponding first and second sand screens 212*a,b*. Each end ring 214*a,b* may be formed from a metal, such as 13 chrome stainless steel, 304L stainless steel, 316L stainless steel, 420 stainless steel, 410 stainless steel, INCOLOY® 825, iron, brass, copper, bronze, tungsten, titanium, cobalt, nickel, an alloy of the foregoing, or the like. Moreover, each end ring 214*a,b* may be coupled or otherwise attached to the outer surface of the base pipe 202 by being welded, brazed, threaded, mechanically fastened, combinations thereof, or the like. In other embodiments, however, one or both of the end rings 214*a,b* may be omitted and the corresponding sand screens 212*a,b* may alternatively be welded or otherwise attached directly to the base pipe 202. As illustrated, the sand screens 212*a,b* may each be radially offset a short distance from the first and second base pipe portions 208*a,b*, respectively, and thereby define a production annulus 216 therebetween.

The sand screens 212*a,b* may serve as a filter medium designed to allow fluids derived from the formation 110 to flow therethrough and into the interior 206 of the base pipe 202. More particularly, each sand screen 212*a,b* may be a fluid-permeable, particulate-restricting device that allows fluids to flow therethrough but generally prevents the influx of particulate matter of a predetermined size and greater. In some embodiments, the sand screens 212*a,b* may be made from a plurality of layers of a wire mesh that are diffusion bonded or sintered together to form a fluid porous wire mesh screen. In other embodiments, however, the sand screens 212*a,b* may have multiple layers of a weave mesh wire material having a uniform pore structure and a controlled pore size that is determined based upon the properties of the formation 110. For example, suitable weave mesh screens may include, but are not limited to, a plain Dutch weave, a twilled Dutch weave, a reverse Dutch weave, combinations thereof, or the like. In other embodiments, however, the sand screens 212*a,b* may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure.

In exemplary operation of the screen assembly 200, fluids from the surrounding formation 110 may be drawn into the annulus 120 and then through one of the sand screens 212*a,b* to the production annulus 216 of the corresponding sand screen 212*a,b*. Particulate matter of a size greater than the screen gauge of the sand screens 212*a,b* may be prevented from passing into the production annulus 216. As known in the art, the "screen gauge" for a wire wrapped screen is the slot distance between axially adjacent wires. Once in the production annulus 216, the fluid may axially traverse the exterior base pipe 202 until locating and entering one of the flow ports 204, which fluidly communicates with the interior 206 of the base pipe 202. The base pipe 202 may be coupled to the tubing string 112 (FIG. 1) and thereby able to produce the incoming fluid to a surface location for collection via the tubing string 112.

In the illustrated embodiment, the first and second sand screens 212*a,b* are axially offset from each other on the base pipe 202 and fluid is generally only able to traverse the wall of the base pipe 202 by passing through the sand screens 212*a,b* and the corresponding flow ports 204 defined in the base pipe 202 below the sand screens 212*a,b*. Accordingly, the base pipe 202 may define and otherwise provide a dead space 218 between the axially adjacent sand screens 212*a,b* where fluids are prevented from traversing the wall of the base pipe 202. As used herein, the term "dead space" refers to an axial length of a sand control screen assembly (e.g., the screen assembly 200) that is typically impermeable to fluid flow. The dead space 218 in FIG. 2 may encompass about 18 inches to about 24 inches from the adjacent end of each corresponding base pipe portion 208*a,b*. The dead space 218 may provide a location where the base pipe portions 208*a,b* are able to be gripped and torqued in making up the coupling 210 connection between the base pipe portions 208*a,b*.

While not explicitly shown in FIG. 2, in at least one embodiment the annulus 120 may be gravel-packed, as generally described above. During gravel packing operations, fluid flow that dehydrates the gravel slurry is only allowed through the wall of the base pipe 202 at the sand screens 212*a,b*. As a result, a sand pack (not shown) may form within the annulus 120 radially adjacent the sand screens 212*a,b*, while a void (not shown) may form within the annulus 120 along at least a portion of the dead space 218. During subsequent production operations, some of the sand pack may settle within the void of the dead space 218 and thereby expose adjacent portions of the sand screens 212*a,b* to inflowing fluid and debris, which could result in detrimental erosive and/or abrasive effects on the sand screens 212*a,b*.

According to embodiments of the present disclosure, however, one or more flow paths may be defined in the base pipe 202 at the dead space 218 to allow radial fluid flow or leakage through the wall of the base pipe 202 without resulting in erosive wear to the base pipe 202. More particularly, as illustrated, one or more perforations 220 may be defined through the wall of the base pipe 202 at the dead space 218 and thereby provide a leak path for fluids to communicate between the annulus 120 and the interior 206 of the base pipe 202 across the dead space 218 during gravel packing operations (and production operations). The perforations 220 may exhibit any geometry or configuration capable of providing fluid communication between the annulus 120 and the interior of the base pipe 202. In some embodiments, for instance, one or more of the perforations 220 may comprise a slot or a lengthwise cut defined through the base pipe 202. In other embodiments, however, one or more of the perforations 220 may comprise a hole that is circular, oval, ovoid, or polygonal (e.g., square, rectangular, etc.).

The perforations 220 may each exhibit an opening size (e.g., width, diameter, etc.) that is equal to or smaller than the screen gauge of the sand screens 212*a,b*. In some embodiments, for example, the sand screens 212*a,b* of the screen assembly 200 may comprise 75-200 mesh screens that exhibit a screen gauge ranging between about 0.008 inches and about 0.002 inches. Accordingly, the width or diameter of the perforations 220 may be equal to or smaller than about 0.008 inches to about 0.002 inches and, therefore, fluids from the surrounding formation 110 may be drawn into base pipe 202 through the perforations 220, while particulate matter of a size greater than the screen gauge may be blocked. As a result, during gravel packing operations, a sand pack may also be able to be formed across the dead space 218.

While the screen gauge for the sand screens 212*a,b* is described herein as ranging between about 0.008 inches and about 0.002 inches, it will be appreciated that the screen gauge may be greater than 0.002 inches or smaller than 0.008 inches, without departing from the scope of the disclosure. Indeed, the screen gauge may be dependent on the particular application, including the known parameters of the formation 110, such as the average particulate size of the formation 110. In any application, the perforations 220 may exhibit an opening size (e.g., width, diameter, etc.) that is equal to or smaller than the predetermined screen gauge of the sand screens 212*a,b*.

Referring now to FIGS. 3A-3C, with continued reference to FIG. 2, illustrated are cross-sectional side views of the progressive formation of an exemplary perforation 302, according to one or more embodiments. The perforation 302 may be similar to or the same as any of the perforations 220 of FIG. 2, and therefore may be defined in the base pipe 202 and otherwise used in the screen assembly 200. The perforation 302 may be formed as a slot-like feature, but may alternatively be formed as a circular, oval, ovoid, or polygonal (e.g., square, rectangular, etc.) hole, without departing from the scope of the disclosure.

In the illustrated embodiment, the perforation 302 may be formed by first milling or otherwise cutting a pocket 304 into an outer surface 306 of the base pipe 202, as shown in FIG. 3A. In some embodiments, as illustrated, the pocket 304 may be formed without penetrating the base pipe 202, such as by cutting only partly through the wall of the base pipe 202. The pocket 304 may then be at least partially filled with an erosion-resistant material 308, as shown in FIG. 3B. The erosion-resistant material 308 may be, but is not limited to, a carbide (e.g., tungsten, titanium, tantalum, or vanadium), a carbide embedded in a matrix of cobalt or nickel by sintering, a ceramic, a surface hardened metal (e.g., nitrided metals, heat-treated metals, carburized metals, etc.), a cermet-based material, a metal matrix composite, a nanocrystalline metallic alloy, an amorphous alloy, a hard metallic alloy, or any combination thereof. The erosion-resistant material 308 may be deposited in the pocket 304 via any suitable process including, but not limited to, weld overlay, thermal spraying, laser beam cladding, electron beam cladding, vapor deposition (chemical, physical, etc.), any combination thereof, and the like.

In at least one embodiment, the erosion-resistant material 308 may comprise tungsten carbide (WC) deposited in a nickel (Ni) matrix using laser beam cladding. Since the WC material is added as part of a Ni matrix binder, a strong metallurgical bond may result that may prevent the erosion-resistant material 308 from separating from the pocket 304 due to thermal expansion or applied mechanical stress at the perforation 302. Moreover, depositing the WC and Ni matrix using laser beam cladding may prove advantageous over other cladding methods since laser beam cladding allows a user to apply smaller deposition beads due to the ability to control the power of the laser. As a result, the user is able to accurately apply the erosion-resistant material 308 into a fairly small-sized pocket 304.

Once the erosion-resistant material 308 is deposited in the pocket 304, the perforation 302 may be completed by cutting through the erosion-resistant material 308 and the underlying base pipe 202 until wholly penetrating the wall of the base pipe 202, as shown in FIG. 3C. Cutting through the base pipe 202 may be accomplished using a variety of cutting or perforating techniques including, but not limited to, laser cutting, water jet cutting, saw cutting, electrical discharge machining (EDM), milling, any combination thereof, and the like. The resulting perforation 302 may exhibit an opening size 312 that is equal to or smaller than the screen gauge of the sand screens 212*a,b* (FIG. 2). In embodiments where the perforation 302 is a slot, the opening size 312 may refer to the width of the slot perforation 302. In embodiments where the perforation 302 is a circular or oval hole, the opening size 312 may refer to a diameter of the hole perforation 302.

The erosion-resistant material 308 may prove advantageous in mitigating or preventing erosion of the perforation 302 during operation, such as during production operations when debris and fluid may be drawn into the base pipe 202 via the perforation 302. As illustrated, the erosion-resistant material 308 may be generally positioned at the opening to the perforation 302 where the maximum amount of erosive or abrasive forces would be assumed.

The erosion-resistant material 308 may generally exhibit a thickness 314 (e.g., depth) at the opening commensurate with the depth of the pocket 304. In other embodiments, however, the erosion-resistant material 308 may protrude a small distance out of the pocket 304 and otherwise past the outer surface 306 of the base pipe 202. In some embodiments, the thickness 314 of the erosion-resistant material 308 may range between about 0.010 inches to about 0.200 inches, but can equally be less than 0.010 inches and greater than 0.200 inches, without departing from the scope of the disclosure. In at least one embodiment, the thickness 314 of the erosion-resistant material 308 may be about 0.060 inches.

In some embodiments, as illustrated, cutting through the erosion-resistant material 308 and the underlying base pipe 202 may result in a cut that tapers outward from the outer surface 306 of the base pipe 202 toward an inner surface 310 thereof. The perforation 302 is depicted in FIG. 3C as being cut through the base pipe 202 in a direction generally orthogonal to the central axis of the base pipe 202. In other embodiments, however, the perforation 302 may alternatively be an angled cut and otherwise cut through the wall of the base pipe 202 at an angle offset from orthogonal to the central axis of the base pipe 202 (e.g., parallel or any angle between orthogonal and parallel), without departing from the scope of the disclosure.

Figure 4A:
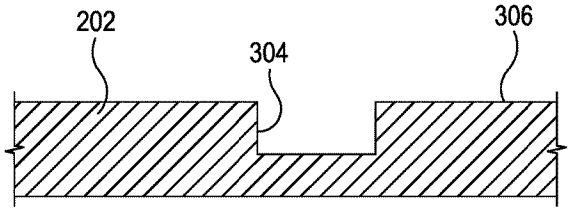
FIGS. 4A-4C depict progressive cross-sectional side views of the formation of another exemplary perforation.
Figure 4B:
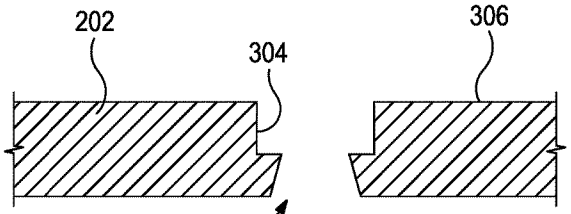
Figure 4C:
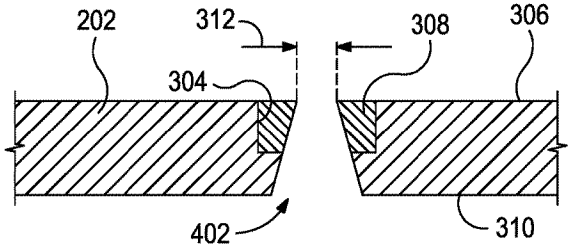

Referring now to FIGS. 4A-4C, illustrated are cross-sectional side views of the progressive formation of another exemplary perforation 402, according to one or more embodiments. The perforation 402 may be similar to the perforation 302 of FIG. 3 and therefore may be best understood with reference thereto, where like numerals represent like elements not described again in detail. Moreover, the perforation 402 may be similar to or the same as any of the perforations 220 of FIG. 2, and therefore may be defined in the base pipe 202 and otherwise used in the screen assembly 200. As with the perforation 302, the perforation 402 may be formed as a slot-like feature, but may alternatively be formed as a circular, oval, ovoid, or polygonal (e.g., square, rectangular, etc.) hole, without departing from the scope of the disclosure.

The perforation 402 may be formed by first milling or otherwise cutting the pocket 304 into the outer surface 306 of the base pipe 202, as shown in FIG. 4A. The base pipe 202 may then be penetrated by cutting through the wall of the base pipe 202 at the pocket 304, as shown in FIG. 4B, using any of the cutting or perforating techniques described herein. In such embodiments, the pocket 304 may be characterized as a type of counter-bore that extends only partly through the wall of the base pipe 202. The erosion-resistant material 308 may then be added to the counter-bore pocket 304, as shown in FIG. 4C, using any of the suitable processes mentioned above. In embodiments where the perforation 402 is a slot-like feature, the erosion-resistant material 308 may be added in two or more parallel passes along the opposing sides of the counter-bore pocket 304. As will be appreciated, this may prove advantageous in allowing a user to control the opening size 312 of the perforation 402 and thereby obtain the tolerances require by a particular application.

As will be appreciated, there are several other ways to form and otherwise define the perforations 302, 402, without departing from the scope of the disclosure. In some embodiments, for instance, the perforations 302, 402 may alternatively be formed by depositing the erosion-resistant material 308 on the outer surface 306 of the base pipe 202 to a predetermined thickness. The perforations 302, 402 may then be completed by cutting through the erosion-resistant material 308 and the underlying base pipe 202 until penetrating the wall of the base pipe 202.

Figure 5:
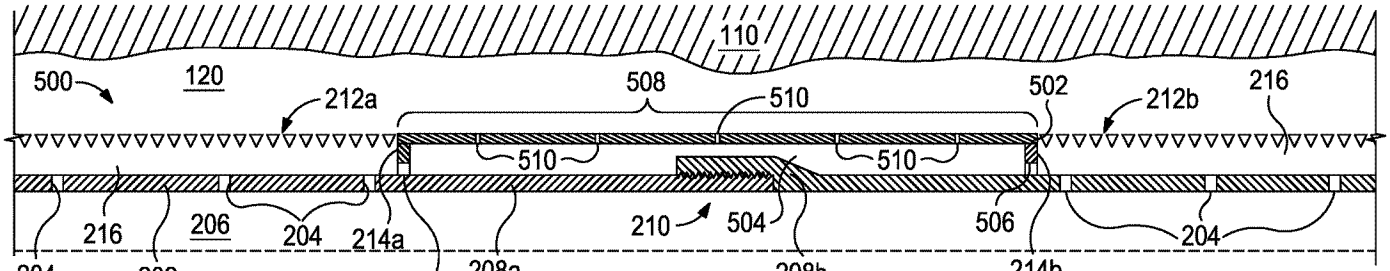
FIG. 5 is a cross-sectional side view of another exemplary sand control screen assembly.

Referring now to FIG. 5, illustrated is a cross-sectional side view of another exemplary sand control screen assembly 500, according to one or more embodiments. The sand control screen assembly 500 (hereafter "the screen assembly 500") may be similar in some respects to the screen assembly 200 of FIG. 2 and therefore may be best understood with reference thereto, where like numerals will represent like components not described again. Similar to the screen assembly 200 of FIG. 2, the screen assembly 500 may include or otherwise be arranged about the base pipe 202 having one or more flow ports 204 defined therein to provide fluid communication between the interior 206 of the base pipe 202 and the surrounding formation 110. In at least one embodiment, fewer flow ports 204 than what are depicted may be employed in the assembly 500. In such embodiments, fluid flow from the surrounding formation 110 may flow axially along the base pipe 202 until locating an inflow point, such a flow port 204 located at an inflow control device (not shown) or a sliding sleeve entry point.

The screen assembly 500 may also include the first and second sand screens 212*a,b* extending axially in opposite directions from the corresponding first and second end rings 214*a,b* and defining corresponding production annuli 216 between the sand screens 212*a,b* and the outer surface of the base pipe 202. In the illustrated embodiment, the first and second sand screens 212*a,b* are axially offset from each other on the base pipe 202 and a shroud 502 may interpose the sand screens 212*a,b* and otherwise extend between the first and second end rings 214*a,b*. In at least one embodiment, the shroud 502 may extend axially across the coupling 210 that attaches the first and second base pipe portions 208*a,b*.

Similar to the sand screens 212*a,b*, the shroud 502 may be radially offset from the outer surface of the base pipe 202 and thereby define a shroud annulus 504 therebetween. In traditional sand control screen assemblies, the shroud 502 may provide an impermeable structure that mechanically couples the sand screens 212*a,b* in the screen assembly 500. In some applications, fluid may be allowed to flow through the shroud annulus 504 by traversing one or more ports 506 defined in each end ring 214*a,b*.

Since fluid is generally only able to traverse the wall of the base pipe 202 by first passing through the sand screens 212*a,b* and then locating flow ports 204 defined in the base pipe 202 below the sand screens 212*a,b*, a dead space 508 may result across the shroud 502. More particularly, the dead space 508 may comprise an axial length of the screen assembly 500 that is traditionally impermeable to fluid flow. Similar to the dead space 218 of FIG. 2, the dead space 508 may result in the formation of sand packs (not shown) within the annulus 120 radially adjacent the sand screens 212*a,b* and a void (not shown) within the annulus 120 along at least a portion of the dead space 518 during gravel packing operations. Moreover, during subsequent production operations, some of the sand pack may settle within the dead space 508 and thereby expose adjacent portions of the sand screens 212*a,b* to inflowing fluid and debris, which could result in detrimental erosive and/or abrasive effects on the sand screens 212*a,b*.

According to embodiments of the present disclosure, however, one or more perforations 510 may be defined through the shroud 502 at the dead space 508 and thereby provide a leak path for fluids to communicate through the shroud 502 and between the annulus 120 and the interior 206 of the base pipe 202 via the shroud annulus 504. The perforations 510 may be similar to the perforations 220 of FIG. 2 and, therefore, may exhibit an opening size (e.g., width, diameter, etc.) that is equal to or smaller than the screen gauge of the sand screens 212*a,b*. As a result, a sand pack may also be able to be formed across the dead space 508 during gravel packing operations. Moreover, the perforations 510 may also be the same as or similar to any of the embodiments of the perforations 302 and 402 described herein with reference to FIGS. 3A-3C and 4A-4C, respectively. Accordingly, the perforations 510 may exhibit any geometry or configuration capable of providing fluid communication between the annulus 120 and the interior of the base pipe 202, and may simultaneously include the erosion-resistant material 308 (FIGS. 3A-3C and 4A-4C) to provide a flow path that will not erode during the life of the screen assembly 500.

Figure 6:
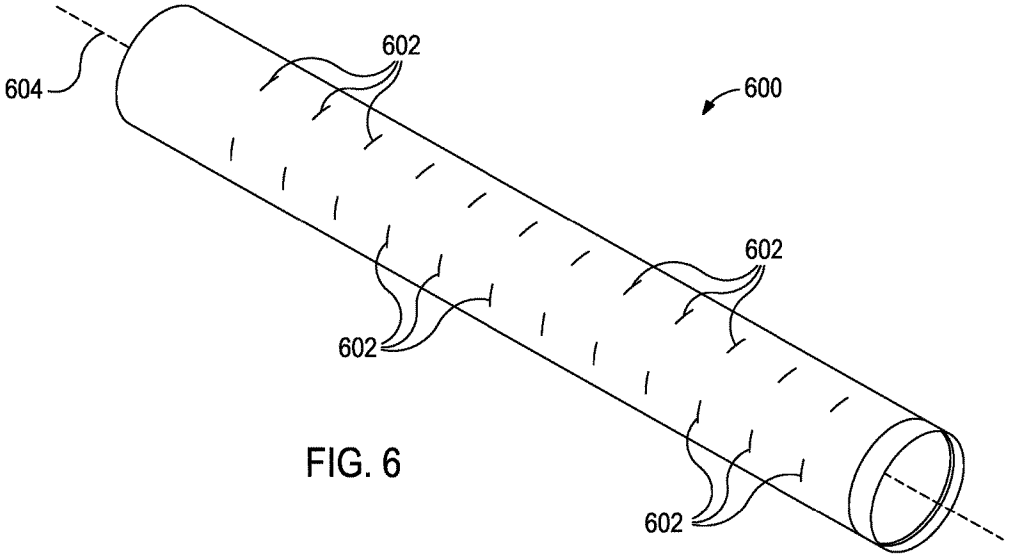
FIG. 6 is an isometric view of an exemplary tubular member that defines a plurality of perforations.

FIG. 6 depicts an isometric view of an exemplary tubular member 600 that defines a plurality of perforations 602, according to one or more embodiments of the present disclosure. The tubular member 600 may be, for example, a length of the base pipe 202 of FIG. 2, such as one of the first and second base pipe portions 208*a,b*. Accordingly, the perforations 602 may be the same as or similar to the perforations 220 of FIG. 2. Alternatively, the tubular member 600 may comprise the shroud 502 of FIG. 5, and the perforations 602 may be the same as or similar to the perforations 510 defined in the shroud 502. The perforations 602 may also be the same as or similar to any of the embodiments of the perforations 302, 402 described herein with reference to FIGS. 3A-3C and 4A-4C, respectively.

In the illustrated embodiment, the perforations 602 are depicted as slots defined in the tubular member 600, but could equally be defined as holes, as described herein. The perforations 602 in FIG. 6 are depicted as horizontal slots that are orthogonal to a central axis 604 of the tubular member 602. Moreover, the perforations 602 are further depicted as being defined in circumferential rows at select axial locations along the tubular member 600 such that a plurality of the perforations 602 may be aligned axially at each selected axial location. It will be appreciated, however, that the perforations 602 may be alternatively be staggered along the tubular member 602 and otherwise not axially aligned with one another, without departing from the scope of the disclosure.

Figure 7C:
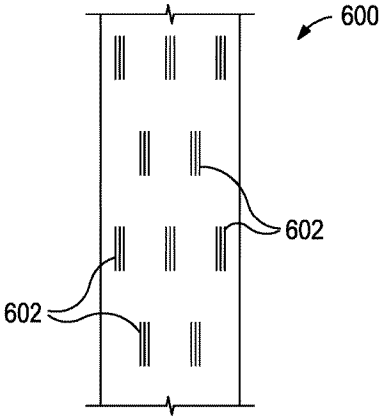
FIGS. 7A-7C depict the tubular member of FIG. 6 and the plurality of perforations in at least three different configurations.
Figure 7B:
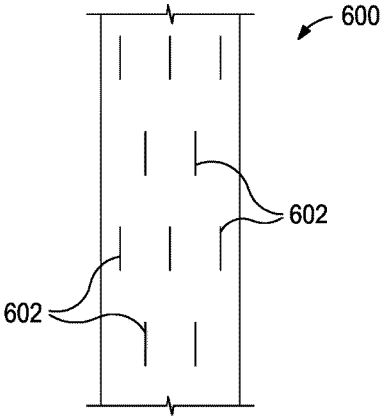
Figure 7A:
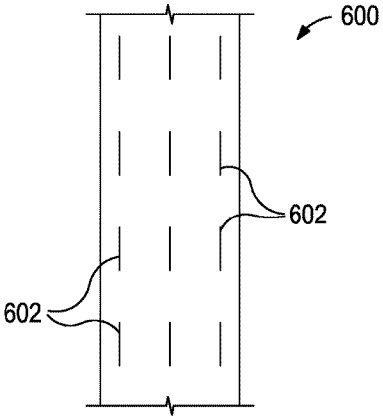

Those skilled in the art will readily appreciate the many alternative configurations that the perforations 602 may assume. Referring to FIGS. 7A-7C, for example, the perforations 602 are defined in the tubular member 600 in at least three different configurations. In FIG. 7A, the perforations 602 are depicted as vertical slots that are aligned with the central axis 604 (FIG. 6). Moreover, the perforations 602 in FIG. 7A are depicted as being defined at select axial locations along the tubular member 600 such that a plurality of the perforations 602 may be aligned axially at each selected axial location. In FIG. 7B, however, the perforations 602 are also depicted as vertical slots but are defined in staggered rows. In FIG. 7C, the perforations 602 are also depicted as vertical slots defined in the tubular member 600, but are further depicted as gang-slotted staggered rows. More specifically, more than one perforation 602 may be defined in the tubular member 600 at any given location.

Accordingly, the perforations 602 may be defined in the tubular member 600 in a variety of ways and/or configurations depending on the application, and similar to the configurations of slotted liners. The perforations 602 may be circumferentially aligned, axially aligned, staggered, etc. Moreover, the perforations 602 may be defined through the tubular member 600 at an angle orthogonal to the central axis 604, as illustrated, or alternatively at any angle offset from orthogonal to the central axis 604. For instance, the perforations 602 may be defined through the tubular member 600 parallel to the central axis 604 or at any angle between orthogonal and parallel to the central axis 604, without departing from the scope of the disclosure.

Embodiments disclosed herein include:

A. A sand control screen assembly that includes a base pipe having an interior and defining one or more flow ports that provide fluid communication between the interior and an exterior of the base pipe, at least one sand screen arranged about the exterior of the base pipe and having a predetermined screen gauge, at least one dead space axially offset from the at least one sand screen and comprising at least one of an axial length of the base pipe and a shroud arranged about the exterior of the base pipe and extending axially from the at least one sand screen, and one or more perforations provided at the at least one dead space and defined through at least one of the axial length of the base pipe and the shroud, wherein each perforation defines an opening having a size equal to or smaller than the predetermined screen gauge.

B. A method that includes introducing a sand control screen assembly into a wellbore, the sand control screen assembly including a base pipe, at least one sand screen arranged about an exterior of the base pipe, and a dead space axially offset from the at least one sand screen, wherein the dead space comprises at least one of an axial length of the base pipe and a shroud arranged about the exterior of the base pipe and extending axially from the at least one sand screen, drawing a fluid through the at least one sand screen and into an interior of the base pipe via one or more flow ports defined in the base pipe, wherein the at least one sand screen has a predetermined screen gauge, and leaking fluid through one or more perforations provided at the dead space and defined through at least one of the axial length of the base pipe and the shroud, wherein each perforation defines an opening having a size equal to or smaller than the predetermined screen gauge.

Each of embodiments A and B may have one or more of the following additional elements in any combination: Element 1: wherein the one or more perforations comprise a geometry selected from the group consisting of a slot, a circular hole, an oval hole, an ovoid hole, and a polygonal hole. Element 2: further comprising an erosion-resistant material deposited at the opening, the erosion-resistant material being a material selected from the group consisting of a carbide, a carbide embedded in a matrix of cobalt or nickel, a ceramic, a surface hardened metal, a cermet-based material, a metal matrix composite, a nanocrystalline metallic alloy, an amorphous alloy, a hard metallic alloy, and any combination thereof. Element 3: wherein the erosion-resistant material is deposited at the opening via a process selected from the group consisting of weld overlay, thermal spraying, laser beam cladding, electron beam cladding, vapor deposition, and any combination thereof. Element 4: wherein at least one of the one or more perforations includes a pocket defined in an outer surface of the at least one of the axial length of the base pipe and the shroud, the erosion-resistant material being deposited at least partially within the pocket. Element 5: wherein the pocket is a counter-bore for the at least one of the one or more perforations and the erosion-resistant material is deposited in the counter-bore using one of laser beam cladding and electron beam cladding. Element 6: wherein at least one of the one or more perforations is formed by depositing the erosion-resistant material on an outer surface of the at least one of the axial length of the base pipe and the shroud and subsequently cutting through the erosion-resistant material and penetrating a wall of the at least one of the axial length of the base pipe and the shroud. Element 7: wherein the one or more perforations are cut through the at least one of the axial length of the base pipe and the shroud using a cutting process selected from the group consisting of laser cutting, water jet cutting, saw cutting, electrical discharge machining (EDM), milling, and any combination thereof. Element 8: wherein at least one of the one or more perforations comprises a slot that is defined orthogonal or parallel, or at any angle between orthogonal and parallel, to a central axis of the at least one of the axial length of the base pipe and the shroud. Element 9: wherein the at least one sand screen comprises a first sand screen and a second sand screen, and the at least one dead space interposes the first and second sand screens and comprises the axial length of the base pipe. Element 10: wherein the axial length of the base pipe comprises an end of a first base pipe portion coupled to an opposing end of a second base pipe portion, and wherein the first sand screen is disposed about the first base pipe portion and the second sand screen is disposed about the second base pipe portion. Element 11: wherein the one or more perforations are defined through one or both of the first and second base pipe portions and provide fluid communication between the interior and the exterior of the base pipe. Element 12: wherein the at least one dead space comprises the shroud, which defines a shroud annulus between the shroud and an outer surface of the base pipe, and wherein the one or more perforations are defined through the shroud to allow fluid communication between the interior and an exterior of the shroud via the shroud annulus.

Element 13: further comprising mitigating erosion of the one or more perforations with an erosion-resistant material deposited at the opening, wherein the erosion-resistant material is a material selected from the group consisting of a carbide, a carbide embedded in a matrix of cobalt or nickel, a ceramic, a surface hardened metal, a cermet-based material, a metal matrix composite, a nanocrystalline metallic alloy, an amorphous alloy, a hard metallic alloy, and any combination thereof. Element 14: wherein the erosion-resistant material is deposited at the opening via a process selected from the group consisting of weld overlay, thermal spraying, laser beam cladding, electron beam cladding, vapor deposition, and any combination thereof. Element 15: wherein at least one of the one or more perforations is formed by cutting a pocket in an outer surface of the at least one of the axial length of the base pipe and the shroud, and depositing the erosion-resistant material at least partially within the pocket. Element 16: wherein at least one of the one or more perforations is formed by depositing the erosion-resistant material on an outer surface of the at least one of the axial length of the base pipe and the shroud, and cutting through the erosion-resistant material and penetrating a wall of the at least one of the axial length of the base pipe and the shroud. Element 17: wherein leaking fluid through the one or more perforations comprises leaking fluid through the one or more perforations comprising a geometry selected from the group consisting of a slot, a circular hole, an oval hole, an ovoid hole, and a polygonal hole. Element 18: further comprising cutting the one or more perforations through the at least one of the axial length of the base pipe and the shroud using a cutting process selected from the group consisting of laser cutting, water jet cutting, saw cutting, electrical discharge machining (EDM), milling, and any combination thereof. Element 19: further comprising depositing a gravel slurry in an annulus defined between the sand control screen assembly and a wall of the wellbore, the gravel slurry including a mixture of the fluid and particulate matter, drawing the fluid out of the gravel slurry through the at least one sand screen and thereby forming a sand pack radially adjacent the at least one sand screen within the annulus, and drawing the fluid out of the gravel slurry through the through one or more perforations provided at the dead space and thereby forming a sand pack radially adjacent the dead space within the annulus.

By way of non-limiting example, exemplary combinations applicable to A, B, and C include: Element 2 with Element 3; Element 2 with Element 4; Element 4 with Element 5; Element 2 with Element 6; Element 9 with Element 10; Element 9 with Element 11; Element 13 with Element 14; Element 13 with Element 15; and Element 13 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sand control screen assembly, comprising:

a base pipe having an interior and defining one or more flow ports along a first section of the base pipe that provide fluid communication between the interior and an exterior of the base pipe;

at least one sand screen arranged about the exterior of the base pipe and having a predetermined screen gauge;

at least one dead space axially offset from the at least one sand screen and comprising a shroud arranged about the exterior of a second section of the base pipe and extending axially from the at least one sand screen; and one or more perforations provided at the at least one dead space and defined through the shroud, wherein each perforation defines an opening having a size equal to or smaller than the predetermined screen gauge, wherein the shroud and the sand screen do not overlap each other, and wherein the one or more flow ports are not along the second section of the base pipe.

2. The sand control screen assembly of claim 1, wherein the one or more perforations comprise a geometry selected from the group consisting of a slot, a circular hole, an oval hole, an ovoid hole, and a polygonal hole.

3. The sand control screen assembly of claim 1, further comprising an erosion-resistant material deposited at the opening, the erosion-resistant material being a material selected from the group consisting of a carbide, a carbide embedded in a matrix of cobalt or nickel, a ceramic, a surface hardened metal, a cermet-based material, a metal matrix composite, a nanocrystalline metallic alloy, an amorphous alloy, a hard metallic alloy, and any combination thereof.

4. The sand control screen assembly of claim 3, wherein the erosion-resistant material is deposited at the opening via a process selected from the group consisting of weld overlay, thermal spraying, laser beam cladding, electron beam cladding, vapor deposition, and any combination thereof.

5. The sand control screen assembly of claim 3, wherein at least one of the one or more perforations includes a pocket defined in an outer surface of the shroud, the erosion-resistant material being deposited at least partially within the pocket.

6. The sand control screen assembly of claim 5, wherein the pocket is a counter-bore for the at least one of the one or more perforations and the erosion-resistant material is deposited in the counter-bore using one of laser beam cladding and electron beam cladding.

7. The sand control screen assembly of claim 3, wherein at least one of the one or more perforations is formed by depositing the erosion-resistant material on an outer surface of the shroud and subsequently cutting through the erosion-resistant material and penetrating a wall of the shroud.

8. The sand control screen assembly of claim 1, wherein the one or more perforations are cut through the shroud using a cutting process selected from the group consisting of laser cutting, water jet cutting, saw cutting, electrical discharge machining (EDM), milling, and any combination thereof.

9. The sand control screen assembly of claim 1, wherein at least one of the one or more perforations comprises a slot that is defined orthogonal or parallel, or at any angle between orthogonal and parallel, to a central axis of the shroud.

10. The sand control screen assembly of claim 1, wherein the at least one sand screen comprises a first sand screen and a second sand screen, and the at least one dead space interposes the first and second sand screens and comprises the axial length of the base pipe.

11. The sand control screen assembly of claim 10, wherein the axial length of the base pipe comprises an end of a first base pipe portion coupled to an opposing end of a second base pipe portion, and wherein the first sand screen is disposed about the first base pipe portion and the second sand screen is disposed about the second base pipe portion.

12. The sand control screen assembly of claim 1, further comprising a first end ring having one or more ports that provide a fluid passageway from the dead space to an region about the exterior of the second section of the base pipe.

13. A method, comprising:

introducing a sand control screen assembly into a wellbore, the sand control screen assembly including a base pipe, at least one sand screen arranged about an exterior of the base pipe, and a dead space axially offset from the at least one sand screen, wherein the dead space comprises a shroud arranged about the exterior of the base pipe and extending axially from the at least one sand screen;

drawing a fluid through the at least one sand screen and into an interior of the base pipe via one or more flow ports defined in the base pipe, wherein the at least one sand screen has a predetermined screen gauge; and leaking fluid through one or more perforations provided at the dead space and defined through the shroud, wherein each perforation defines an opening having a size equal to or smaller than the predetermined screen gauge, wherein the shroud and the sand screen do not overlap each other, and wherein the one or more flow ports are not along a section of the base pipe that is covered by the shroud.

14. The method of claim 13, further comprising mitigating erosion of the one or more perforations with an erosion-resistant material deposited at the opening, wherein the erosion-resistant material is a material selected from the group consisting of a carbide, a carbide embedded in a matrix of cobalt or nickel, a ceramic, a surface hardened metal, a cermet-based material, a metal matrix composite, a nanocrystalline metallic alloy, an amorphous alloy, a hard metallic alloy, and any combination thereof.

15. The method of claim 14, wherein the erosion-resistant material is deposited at the opening via a process selected from the group consisting of weld overlay, thermal spraying, laser beam cladding, electron beam cladding, vapor deposition, and any combination thereof.

16. The method of claim 14, wherein at least one of the one or more perforations is formed by:

cutting a pocket in an outer surface of the shroud; and depositing the erosion-resistant material at least partially within the pocket.

17. The method of claim 14, wherein at least one of the one or more perforations is formed by:

depositing the erosion-resistant material on an outer surface of the shroud; and cutting through the erosion-resistant material and penetrating a wall of the shroud.

18. The method of claim 13, wherein leaking fluid through the one or more perforations comprises leaking fluid through the one or more perforations comprising a geometry selected from the group consisting of a slot, a circular hole, an oval hole, an ovoid hole, and a polygonal hole.

19. The method of claim 13, further comprising cutting the one or more perforations through the shroud using a cutting process selected from the group consisting of laser cutting, water jet cutting, saw cutting, electrical discharge machining (EDM), milling, and any combination thereof.

20. The method of claim 13, further comprising:

depositing a gravel slurry in an annulus defined between the sand control screen assembly and a wall of the wellbore, the gravel slurry including a mixture of the fluid and particulate matter;

drawing the fluid out of the gravel slurry through the at least one sand screen and thereby forming a sand pack radially adjacent the at least one sand screen within the annulus; and drawing the fluid out of the gravel slurry through the through one or more perforations provided at the dead space and thereby forming a sand pack radially adjacent the dead space within the annulus.

* * * * *